US006375495B1

(12) United States Patent
Szeto

(10) Patent No.: US 6,375,495 B1
(45) Date of Patent: Apr. 23, 2002

(54) MIXED SIGNAL CONNECTOR

(75) Inventor: Colin Y. M. Szeto, North York (CA)

(73) Assignee: ATI International SRL, Barbados (KN)

( * ) Notice: Subject to any disclaimer, the term of this patent is extended or adjusted under 35 U.S.C. 154(b) by 0 days.

(21) Appl. No.: 09/484,552

(22) Filed: Jan. 18, 2000

(51) Int. Cl.[7] ..... H01R 13/60; H01R 13/66
(52) U.S. Cl. ..... 439/540.1; 439/536
(58) Field of Search ..... 439/540.1, 536; 361/784, 785

(56) References Cited

U.S. PATENT DOCUMENTS 5,356,311 A * 10/1994 Liu ..... 439/536
5,900,867 A * 5/1999 Schindler et al. ..... 345/327
2001/0014927 A1 * 8/2001 Chang et al. ..... 710/102

* cited by examiner

*Primary Examiner*—Khiem Nguyen
*Assistant Examiner*—Chandrika Prasad
(74) *Attorney, Agent, or Firm*—Vedder, Price, Kaufman & Kammholz

(57) ABSTRACT

A connector that provides support for analog, digital, and high frequency analog signals is presented. The various connector positions of the connector are spaced in a manner that minimizes the surface area of the front face of the connector such that it can be accommodated within the bracket dimensions of an ATX bracket along with a DVI connector. The number of connector positions included in the connector allow for a large number of audio and video signals to be communicated to and from an expansion card included in a personal computer chassis.

3 Claims, 3 Drawing Sheets

MIXED SIGNAL CONNECTOR

FIELD OF THE INVENTION

The invention relates generally to a mixed signal connector and more specifically to a mixed signal connector for use with an expansion card in a personal computer.

BACKGROUND OF THE INVENTION

Computers are increasingly being used in multi-media applications that involve both video and audio processing. In many cases such processing is off loaded from the central processing unit of the computer system to specialized processors such as video graphics processors that may also perform audio processing functions. In many cases, these video graphics processors are implemented on expansion cards that are plugged into computer systems such as personal computers.

In order to provide all of the audio and video signals to such video graphics expansion cards for processing, a wide variety of different signal formats (i.e. analog and digital) must be supported. As the number of signals provided to such expansion cards increases,.the number of required connector positions increases. In addition to this, some connectors are quite complex and large, such as the Digital Video Interface (DVI) connector developed by Intel for driving digital flat panel displays. The dimensions of the DVI connector with respect to the mounting surface are almost twice the size of the standard video graphics adapter (VGA) connectors commonly used for driving conventional displays today.

In order to allow the signals required by the video graphics expansion card to be provided to the card, the connectors are typically placed along the backside of the card as it mounts in the personal computer chassis. A bracket that is used for mounting the expansion card in the computer chassis includes a number of apertures that allow access to the various connectors from external to the personal computer chassis.

FIG. 1 illustrates a view of a prior art bracket that is shown to include a number of apertures corresponding to various connectors that are commonly used for relaying audio and video signals today. The right-most aperture is designed for a VGA connector commonly used for driving a display, whereas the other apertures may be used to carry signals such as analog and digital audio information. Unfortunately, the connectors corresponding to the apertures in the bracket illustrated in FIG. 1 cannot support the number of signals that maybe required by some video graphics expansion cards being developed today. In addition to not supporting enough signals, the connectors illustrated in FIG. 1 do not provide the mixed signal and other functional capabilities that may be required by such video graphics expansion cards.

Therefore, a need exists for an improved mixed signal connector that can support a large number of signals that may include analog signals, digital signals, and high frequency analog signals where the footprint of the connector is limited in size such that it is easily accommodated within the space available on an ATX bracket that may include additional connectors for other signals.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF A PREFERRED EMBODIMENT OF THE INVENTION

Generally, the present invention provides a connector that provides support for analog, digital, and high frequency analog signals. The various connector positions are spaced in a manner that minimizes the surface area of the front face of the connector such that it can be accommodated within the bracket dimensions of an ATX bracket along with a DVI connector. The number of connector positions included in the connector allow for a large number of audio and video signals to be communicated to and from an expansion card included in a personal computer chassis.

Figure 2:
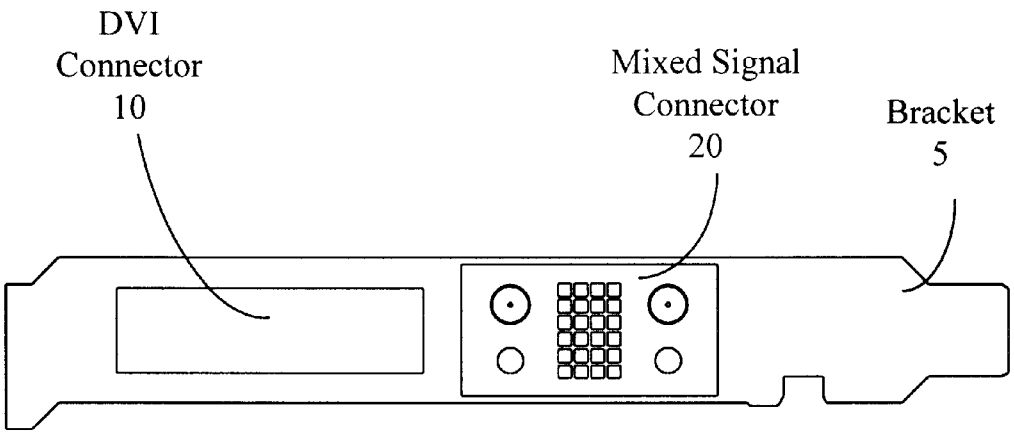
FIG. 2 illustrates an ATX bracket that includes apertures for providing access to a mixed signal connector in accordance with a particular embodiment of the present invention.

The invention can be better understood with reference to FIGS. 2–5. FIG. 2 illustrates a bracket 5 that is drawn to the approximate dimensions of an ATX bracket that is associated with ATX form factor expansion cards that are mounted in personal computers. The ATX motherboard form-factor specifications describe the mechanical and electrical specifications for building a personal computer motherboard and the design considerations to develop a chassis to house the motherboard. The ATX form factor is a standard that is well known in the art, and the dimensions of the bracket 5 are also well known in the art.

The bracket 5 is shown to include two apertures within which the mounting faces of a DVI connector 10 and a mixed signal connector 20 can be positioned. The DVI connector 10 and mixed signal connector 20 are integrated onto the expansion card to which the bracket 5 mounts where the bracket 5 facilitates placement of the expansion card within the personal computer chassis.

Figure 1:
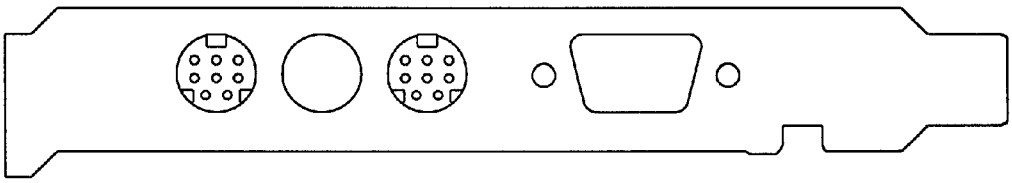
Figure 1. (PRIOR ART)
FIG. 1 illustrates a view of an ATX bracket and the apertures associated with prior art connectors.

The DVI connector 10 enables the expansion card, which is preferably a video graphics expansion card that performs video graphics and possibly audio processing functions, to drive a digital flat panel display. As stated earlier, the DVI connector is a standard developed by Intel Corporation of Santa Clara, Calif. U.S.A. As can be seen, the mounting face of the DVIJ connector 10 requires a large amount of the available area on the ATX bracket 5. Therefore, in order to provide the required additional signals to and from video graphics expansion cards, a mixed signal connector such as the mixed signal connector 20 whose mounting (front) face requires a limited amount of area within the bracket 5 is necessary. Note that the connectors in prior art systems (such as those illustrated in FIG. 1) that carried the signals corresponding to the various connector positions within the mixed signal connector 20 were not required to fit into such a small amount of area. This is because the VGA connector, illustrated as the right most connector aperture within the bracket drawn in FIG. 1, required much less area on the bracket does than the DVI connector 10.

Thus, the dimensions of the front face of the mixed signal connector 20 are preferably sized such that the mixed signal connector and a DVI connector can be arranged on the connector mounting surface available on an ATX expansion bracket. In one embodiment, the dimensions of the front face of the connector mounting are no greater than 1.5 inches (approximately thirty-eight (38) millimeters) in a first dimension and 0.75 inches (approximately nineteen (19) millimeters) in a second dimension where the first dimension is shown as the horizontal dimension in FIG. 2 and the second dimension is the vertical dimension. More preferably, the dimensions of the front face of the connector mounting are no greater than 1.125 inch (approximately twenty-nine (29) millimeters) in the first dimension and 0.625 inches (approximately fourteen (14) millimeters) in the second dimension.

Figure 3:
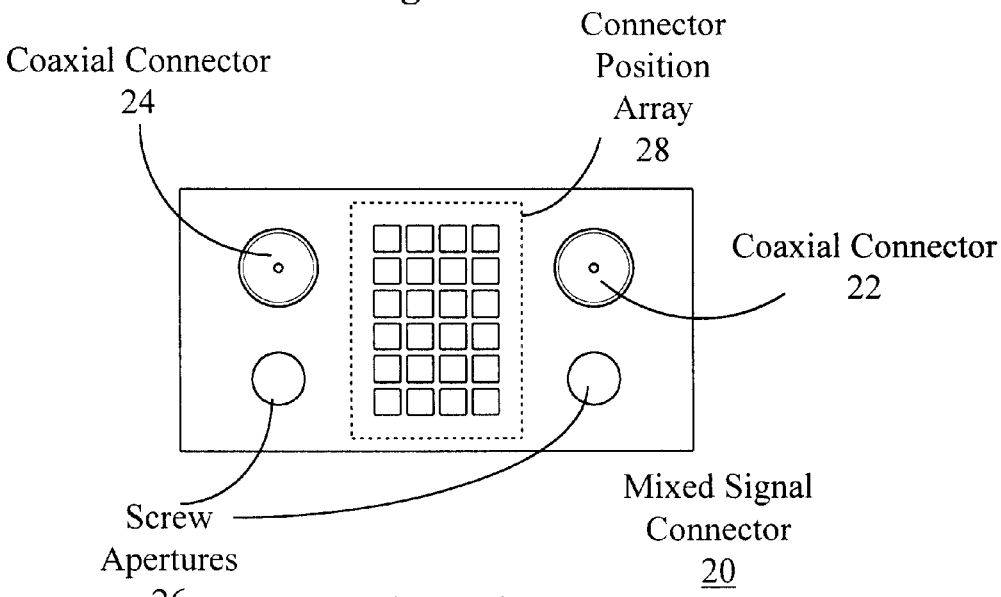
FIG. 3 illustrates an enlarged view of the front face of a mixed signal connector in accordance with a particular embodiment of the present invention.

FIG. 3 illustrates an enlarged view of the front face of the mixed signal connector 20. The particular embodiment illustrated in FIG. 3 is shown to include coaxial connectors 22 and 24, a connector position array 28 that includes a plurality of connector positions, and screw apertures 26. The coaxial connectors 22 and 24 are coaxial cable couplings that may provide a coupling for a frequency modulated (FM) radio input and a television cable input. Thus the video graphics expansion card upon which the mixed signal connector 20 is mounted may receive television signals via the television cable input and FM radio signals via the FM radio input. The expansion card can then perform processing operations on the signals received or simply convert these received signals to produce video and audio output signals that are compatible with various displays or that are compatible with the inputs to other equipment such as a stereo amplifier. The high frequency signals carried over the signal lines that utilize the coaxial connectors 22 and 24 may include signals having a frequency of approximately 48–856 megahertz such that both FM signals and those relating to cable television can be carried.

The front face of the mixed signal connector 20 as shown in FIG. 3 is adapted to couple to a mating connector, which in turn is coupled to a cable. The cable may be coupled to a user-friendly interface that includes a number of connector couplings such as RCA jacks, coaxial cable connectors, and other connector couplings. The couplings on the user-friendly interface that allow a user of the computer within which the expansion card is mounted to provide various input signals to the computer and utilize the output signals received from the computer to drive a stereo, video cassette recorder, television set, or similar devices that may receive and utilize audio and video signals.

Thus, the connector described herein is made up of a connector mounting 27 that includes the front face illustrated in FIG. 3 where at least one coaxial coupling and an array of connector positions are mounted on the connector mounting 27. Each connector position of the array of connector positions is adapted to couple to a portion of the mating connector at a position on the front face. In one embodiment, each of the connector positions within the connector position array 28 is a small hole that includes contacts where the mating connector includes pins or jack poles that are inserted into the small hole where the pin or jack pole makes electrical contact with the contacts included in the hole.

The screw apertures 26 permit the mating connector to physically couple to the front face of the mixed signal connector 20 in a manner that provides a great a deal of mechanical stability. Screws included in the mating connector are threaded into the screw apertures 26 in order to provide this stable coupling. In other embodiments, connectors other than screws may be used to achieve such mechanical stability.

Figure 4:
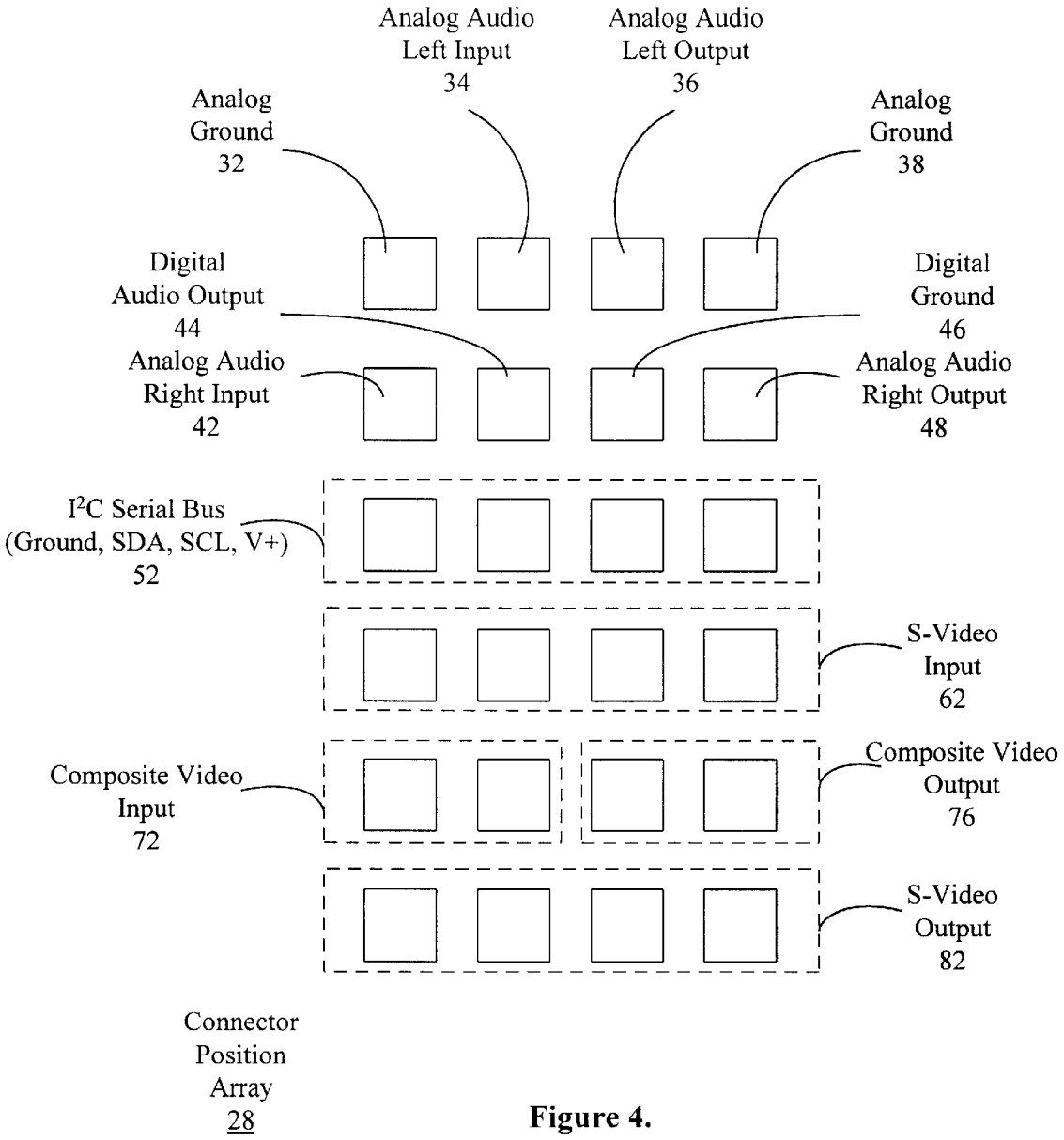
FIG. 4 illustrates an expanded view of the connector position array of the mixed signal connector of FIG. 3.

FIG. 4 illustrates a more detailed representation of the connector position array 28 that includes various signals that may correspond to particular connector positions in the position array 28. The array of connector positions 28 may include at least 20 connector positions where the array of connector positions supports both audio and video connections. In the embodiment illustrated in FIGS. 3 and 4, the array of connector positions includes 24 connector positions that support the various signals illustrated in FIG. 4. As is apparent to one of ordinary skill in the art, a slight increase in size of the mixed signal connector 20 would provide additional space for expansion of the connector position array 28 such that additional connector positions could be provided for additional signal carrying capability.

The first row of connector positions is shown to include positions for an analog ground 32, an analog audio left input 34, an analog audio left output 36, and another analog ground 38. The second row is shown to include positions for an analog audio right input 42, a digital audio output 44, a digital ground 46, and an analog audio right output 48.

The third row is shown to include connector positions for an inter-integrated circuit ($I^2C$. serial bus. The $I^2C$ serial bus is a standard serial bus known in the art that requires four connector positions. The four connector positions for the $I^2C$ serial bus include a ground, a serial data (SDA) signal, a serial clock (SCL) signal, and a signal. Positive voltage supply (V+).

The fourth row is shown to include connector positions corresponding to an S-video input 62. The signals that utilize the four connector positions allocated to the S-video input 62 are known in the art. The corresponding S-video output connector positions 82 are shown in the bottom most, or sixth row of the connector position array 28. The fifth row is dedicated to composite video input connector positions 72 and composite video output connector positions 76.

The arrangement of the connector positions in the connector position array 28 as illustrated in FIG. 4 is one example of the numerous possible arrangements. A number of considerations must be taken into account when determining the placement of various connector positions within the array. One consideration is that the various positions correspond to both analog and digital signals. Mixed-signal connectors must take into account the noise to be generated by digital signals that are switching at a high rate of speed. In addition, the fact that the connector position array 28 is part of a connector that also includes high frequency analog connectors (coaxial connectors 22 and 24) that are very sensitive to noise can influence the positioning of the various connector positions.

The connector position placement in the connector position array 28 is preferably performed in a manner that minimizes signal-to-signal crosstalk and also noise injection. The coaxial connectors 22 and 24 are preferably highly shielded in order to reduce noise injection, and the analog signals are preferably interspersed amongst the digital signals to minimize cross talk between the digital signals.

Figure 5:
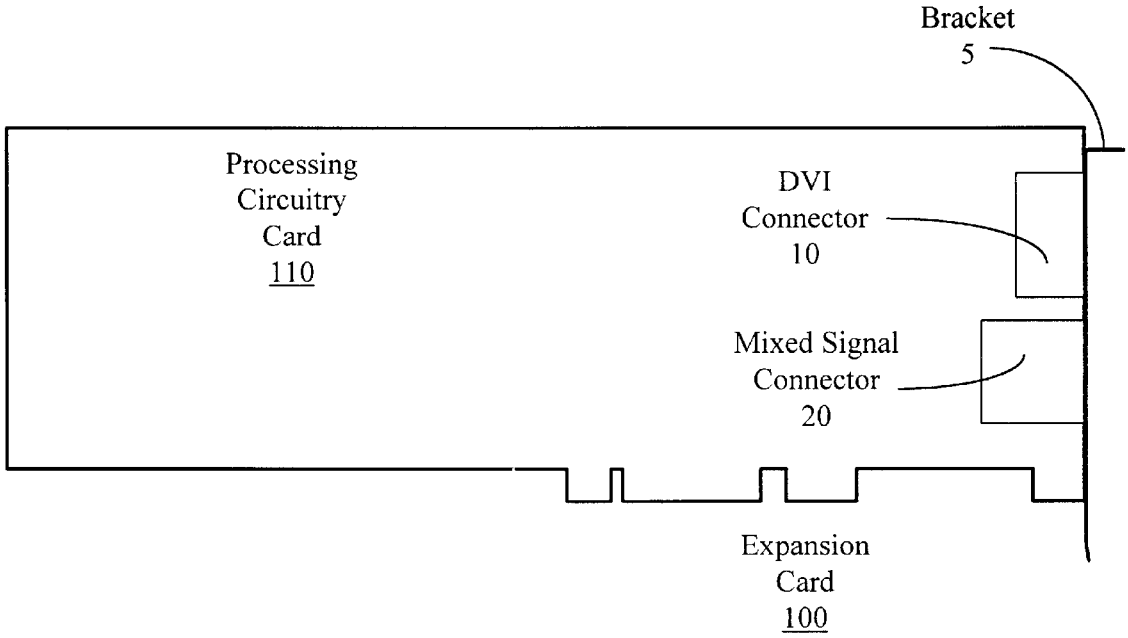
FIG. 5 illustrates an expansion card that includes a mixed signal connector in accordance with a particular embodiment of the present invention.

FIG. 5 illustrates an expansion card 100 that includes a processing circuitry card 110 and that is coupled to a DVI connector 10 and a mixed signal connector 20 such as that illustrated in FIG. 3. The processing circuitry card 110 includes video graphics processing circuitry 120 for processing video graphics data. The processing circuitry card 110 may also include audio processing circuitry or other circuitry designed for performing signal conversion to promote interoperability between different video and audio components that utilize different signaling formats. The processing circuitry card 110 is adapted to couple to a computing system. The particular card illustrated in FIG. 5 represents an ATX form factor expansion card that is adapted to couple to an expansion slot in a personal computer.

The bracket 5 is shown to be positioned with respect to the expansion card 100 such that it facilitates mounting of the expansion card 100 in a personal computer. Through such a mounting, the apertures included in the bracket 5 enable external access to the connectors 10 and 20. Note that the mixed signal connector 20 has been sized such that it is possible to provide access to both the mixed signal connector 20 and the DVI connector 10 through apertures formed in the bracket 5. Although the example illustrated in FIG. 5 is specific to an ATX form factor expansion card, it should be recognized that providing a mixed signal connector that incorporates a large number of connector positions within a very limited amount of surface area would be advantageous in numerous other devices that require support of a large number of signals where the signals include analog, digital, and high frequency analog signals.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A video graphics expansion card assembly, comprising:

an expansion card bracket for mounting the video graphics expansion card in a computing system, the expansion card bracket including a first aperture adapted to receive a digital video interface (DVI) connector and a second aperture adapted to receive a mixed signal connector;

a video graphics expansion card including the digital video interface connector coupled thereto, and including the mixed signal connector, the mixed signal connector including, at least one coaxial cable connector operatively coupled to a face of the mixed signal connector, and a connector position array, also mounted to the face of the mixed signal connector, wherein the connector position array includes a plurality of small holes that include contacts where a mating connector can make electrical contact therewith when the contacts provide coupling for at least one of analog audio signals, a digital audio signal, composite video signals, S-video signals, and $I^2C$ serial bus.

2. The video graphics expansion card assembly of claim 1 wherein the connector position array includes at least 24 connector positions, and wherein the array of connector positions provides connector positions for two channel audio in and two channel audio out signals, at least one analog ground signal, a digital audio signal, at least one digital ground signal, an $I^2C$ serial bus, S-video in and S-video out signals and composite video in and composite video out signals.

3. The graphics expansion card assembly of claim 1, including another coaxial cable connector coupled to the face of the mixed signal connector.

* * * * *